US005862931A

United States Patent [19]

Cox et al.

[11] Patent Number: 5,862,931

[45] Date of Patent: Jan. 26, 1999

[54] COLLAPSIBLE SHIPPING CONTAINER

[76] Inventors: Charles F. Cox, 6916 Incas, North Little Rock, Ark. 72116; Thomas F. Cox, 15820 Patriot Dr., Little Rock, Ark. 72212

[21] Appl. No.: 841,088

[22] Filed: Apr. 29, 1997

Related U.S. Application Data

[63] Continuation of Ser. No. 581,392, Dec. 29, 1995, abandoned.

[51] Int. Cl.[6] ..... B65D 6/22; B65D 6/26; B65D 21/32

[52] U.S. Cl. ..... 220/6; 206/508; 220/4.28; 220/4.32; 220/4.33; 220/7; 220/684

[58] Field of Search ..... 220/6, 4.31, 4.32, 220/4.33, 7, 617, 685, 639, 646, 1.5, 4.28, 4.01; 217/12 R, 13, 15, 43 R, 45, 47, 43 A; 206/508, 511

[56] References Cited

U.S. PATENT DOCUMENTS

| | | | |
|---|---|---|---|
| 2,910,322 | 10/1959 | Magor | 220/646 X |
| 3,040,925 | 6/1962 | Mills . | |
| 3,266,656 | 8/1966 | Kridle | 220/4 |
| 3,401,814 | 9/1968 | Chiswell et al. | 220/4 |
| 4,042,111 | 8/1977 | Smith | 206/511 X |
| 4,049,430 | 6/1978 | Cauley | 220/646 X |
| 4,050,604 | 9/1977 | Flanders | 220/4 F |
| 4,174,045 | 11/1979 | Heller et al. | 220/4 F |
| 4,452,366 | 6/1984 | Nagai et al. | 220/4.28 X |
| 4,858,779 | 8/1989 | Zimmerlund | 220/6 |
| 5,076,458 | 12/1991 | Weiner et al. | 220/908 X |
| 5,161,709 | 11/1992 | Oestreich, Jr. | 220/6 |
| 5,185,193 | 2/1993 | Phenicie et al. | 220/1.5 X |
| 5,236,099 | 8/1993 | Fties et al. | 220/4.31 |
| 5,253,763 | 10/1993 | Kirkley et al. | 206/600 |
| 5,341,950 | 8/1994 | Sinz | 220/6 |

FOREIGN PATENT DOCUMENTS

| | | | |
|---|---|---|---|
| 704105 | 4/1966 | Italy | 229/198.1 |
| 122999 | 7/1984 | Japan | 220/646 |

*Primary Examiner*—Stephen J. Castellano
*Assistant Examiner*—Niki M. Eloshway
*Attorney, Agent, or Firm*—Ray F. Cox, Jr.

[57] ABSTRACT

A collapsible shipping container comprising a base portion, three walls which are hinged to the base at their respective lower edges, a fourth wall which assembles to the base by sliding into a channel, four identical corner posts having a pair of channels for sliding on to the vertical edges of the four sides, and a top lid. The hinges on the side walls allow the three hinged side panels to fold over onto each other in a tightly layered configuration. The hinges do not carry a load which allows the containers to be stacked. The corner posts have locking pins which fit into holes on the tops of the walls to firmly lock the walls together. Skids are provided on the bottom portion to allow the container to be picked up and moved by forklifts. The top lid holds the corner posts and completely encloses the collapsed container. Alternatively, the container may accept snap-in casters on the bottom.

4 Claims, 15 Drawing Sheets

COLLAPSIBLE SHIPPING CONTAINER

This application is a continuation of application, Ser. No. 08/581,392 filed on Dec. 29, 1995, now abandoned.

BACKGROUND OF THE INVENTION

The present invention relates generally to the field of containers for the transportation of general cargo, and in particular, to containers which may be collapsed into a compact configuration for storage or return to a point of origin.

Shipping containers in which the walls fold to form a collapsed configuration are well known. Such containers have the advantages of allowing a compact folded configuration which facilitates storage and shipment. Quite commonly, a manufacturer ships parts to a distant point of assembly from which empty containers must be returned to the manufacturer. It is of course highly inefficient to ship empty containers; therefore, many attempts have been made to develop a collapsible container which demonstrates efficiency, durability, ease of use, minimum collapsed configuration, flexibility of use, and strength.

One of the problems associated with the use of collapsible containers is ensuring that the unfolded configuration has the requisite degree of strength. Various patents disclose the use of corner posts to tie together the side panels in a collapsible shipping container. U.S. Pat. No. 3,266,656 issued to Kridle on Aug. 16, 1966 for "Demountable Shipping Case" discloses a collapsible shipping container with a base having a flange around its outside edge, four rectangular side panels, four corner posts each having a pair of channels to receive the vertical edges of the side panels, and a cover. The side panels of Kridle, however, are not hinged and the corner posts do not disclose the use of pins to tie the side panels together.

U.S. Pat. No. 4,174,045 issued to Heller on Nov. 13, 1979 for "Loading Platform" does, however, disclose corner posts which have a plate at the top with a slot to receive extensions formed in the top edges of the side panels.

Another shipping container disclosing corner connectors is U.S. Pat. No. 5,236,099 issued to Fties et al. on Aug. 17, 1993 for "Plastic Knock Down Bin-Pallet for Loading, Transporting and Storing Fruits, Vegetables, Fish or Other Foods." Fties et al. disclose corner connectors which have a pair of channels for interlocking with the side panels of a collapsible container.

U.S. Pat. No. 3,401,814 issued to Chiswell on Sep. 17, 1968 for "Collapsible Shipping Container" discloses a container having a base and four corner posts, four detachable side panels and a roof section. The same type of corner posts are disclosed in U.S. Pat. No. 4,050,604 issued to Flanders on Sep. 27, 1977 for "Disassembleable, Reusable Container." In both of these patents, the corner posts are simple angle pieces which do not provide channels to receive the edges of the side panels.

Many designs of collapsible shipping containers employ the concept of folding the side walls about hinges. Some of the problems associated with the use of hinges include the durability of the container and its strength, both in the collapsed and the unfolded configuration. One particular problem is to avoid the loading of the hinges which can promote premature failure in the fully unfolded configuration and which may limit the ability of the folded or collapsed configuration to be stacked for efficient shipment. The following are examples of patents for collapsible shipping containers in which some or all of the walls are hinged to the bottom portion. U.S. Pat. No. 4,858,779 issued to Zimmerlund on Aug. 22, 1989 for "Container" is a somewhat complicated arrangement for folding the sides together to form a compact package. Zimmerlund does, however, recognize the problem of arranging the hinges so that the panels bear on one another and not on the hinge structure itself.

U.S. Pat. No. 5,253,763 issued to Kirkley on Oct. 19, 1993 for "Collapsible Container" discloses a container in which two of the side walls are hinged and two of the side walls are removable for stacking onto the folded hinged sides. Kirkly does not disclose the use of corner posts and the appropriate stacked configuration is obtained by folding the side panels about central hinges.

A final example of a shipping container in which the sides are hinged is U.S. Pat. No. 3,040,925 issued to Mills on Jun. 26, 1962 for "General Cargo Shipping Container." Mills recognizes the desirability of being able to open a side of a shipping container for easy loading and unloading.

SUMMARY OF THE INVENTION

The collapsible shipping container of the present invention comprises a base portion, three walls which are hinged to the base at their respective lower edges, a fourth wall which assembles to the base by sliding into a channel, four identical corner posts which have a pair of channels for sliding on to the vertical edges of the four sides, and a top lid. There are a number of significant features to various embodiments of the invention: (1) there are no loose parts or connectors required to assemble the container other than the parts mentioned above, (2) the hinges on the side walls are mounted on short "stub walls" raised above the base to allow the three hinged side panels to fold over onto each other in a tightly layered configuration, (3) the hinges on the side panels are designed so that they do not carry a load which allows the containers to be stacked, one on top of another, (4) the corner posts are provided with locking pins which fit into holes on the tops of the side panels to firmly lock the side panels together, and (5) skids are provided on the bottom portion to allow the container to be picked up and moved by forklifts. There are various other features to other embodiments of the invention; for example, the fully collapsed configuration of the container and the manner in which the top lid holds the corner posts and completely encloses the remaining portion of the collapsed container. Other features include the ability to stack the folded containers, sizing of the fully unfolded container to fit in semi-trailers or modular shipping containers, and the ability to accept snap-in casters on the bottom.

To overcome the limitations and disadvantages of the prior art, it is an object of the present invention to provide for a collapsible shipping container which collapses to a minimum configuration which is efficient to store and ship.

It is a further object of the present invention to provide for a collapsible shipping container which exhibits a high degree of strength and durability in both the collapsed and the fully unfolded configuration.

It is an additional object of the present invention to provide for a collapsible shipping container which minimizes the number of parts required to assemble the shipping container in its fully unfolded configuration and provides means to store parts in such a way as to avoid or minimize the loss of loose parts and to avoid the need for tools to assemble and disassemble the container.

It is a still further object of the present invention to provide for a collapsible shipping container which is so oriented and configured as to promote a natural and obvious mechanism for folding and unfolding the shipping container, thereby maximizing efficiency in using the invention.

Further objects and advantages of the present invention will become apparent from the detailed description of the preferred embodiments considered in conjunction with the appended drawings as described following:

DETAILED DESCRIPTION OF THE PREFERRED EMBODIMENTS

Figure 1:
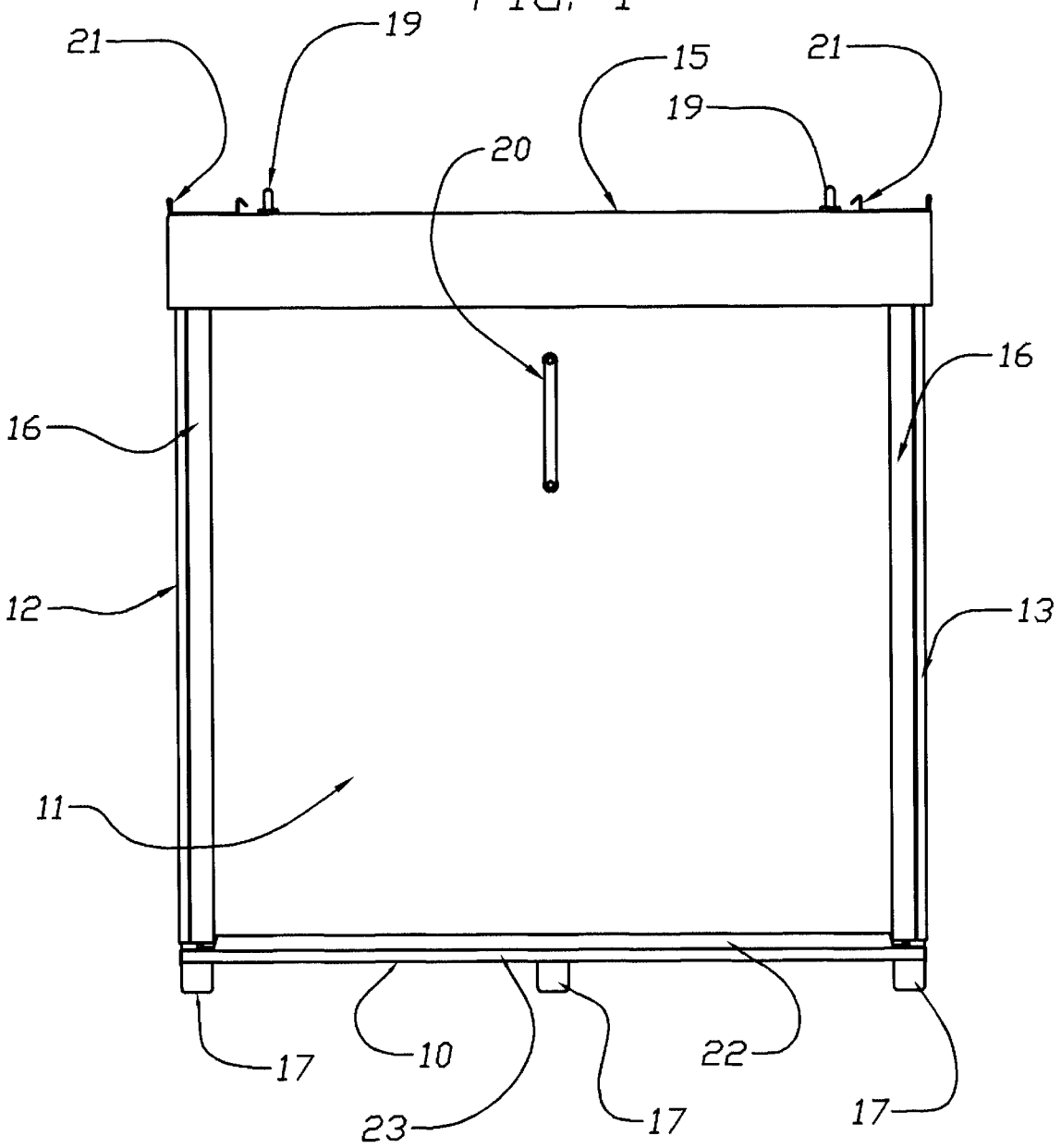
FIG. 1 is a front elevation of the shipping container of the present invention in the fully unfolded configuration.
Figure 2:
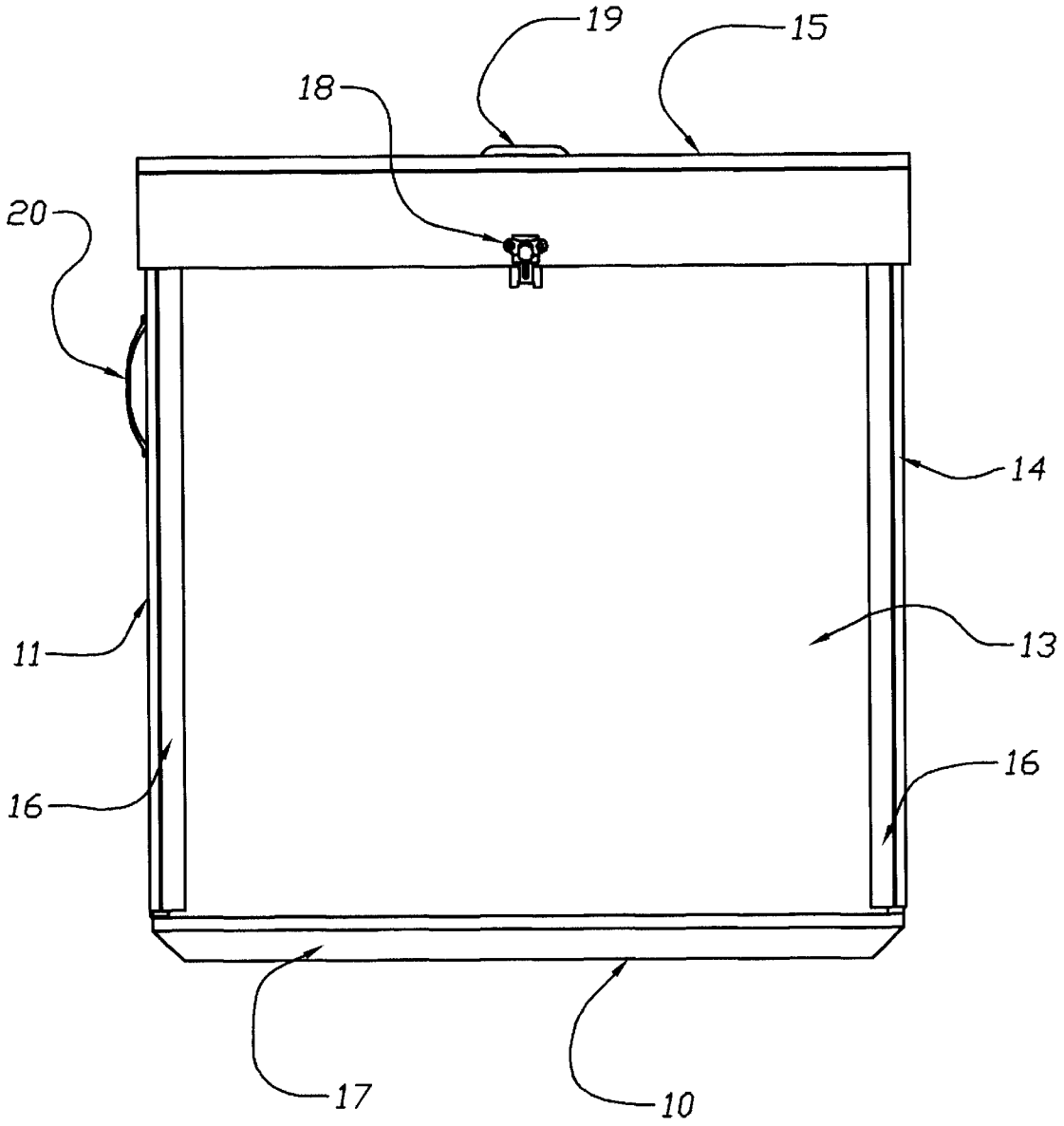
FIG. 2 is a right side elevation of the shipping container fully unfolded.
Figure 3:
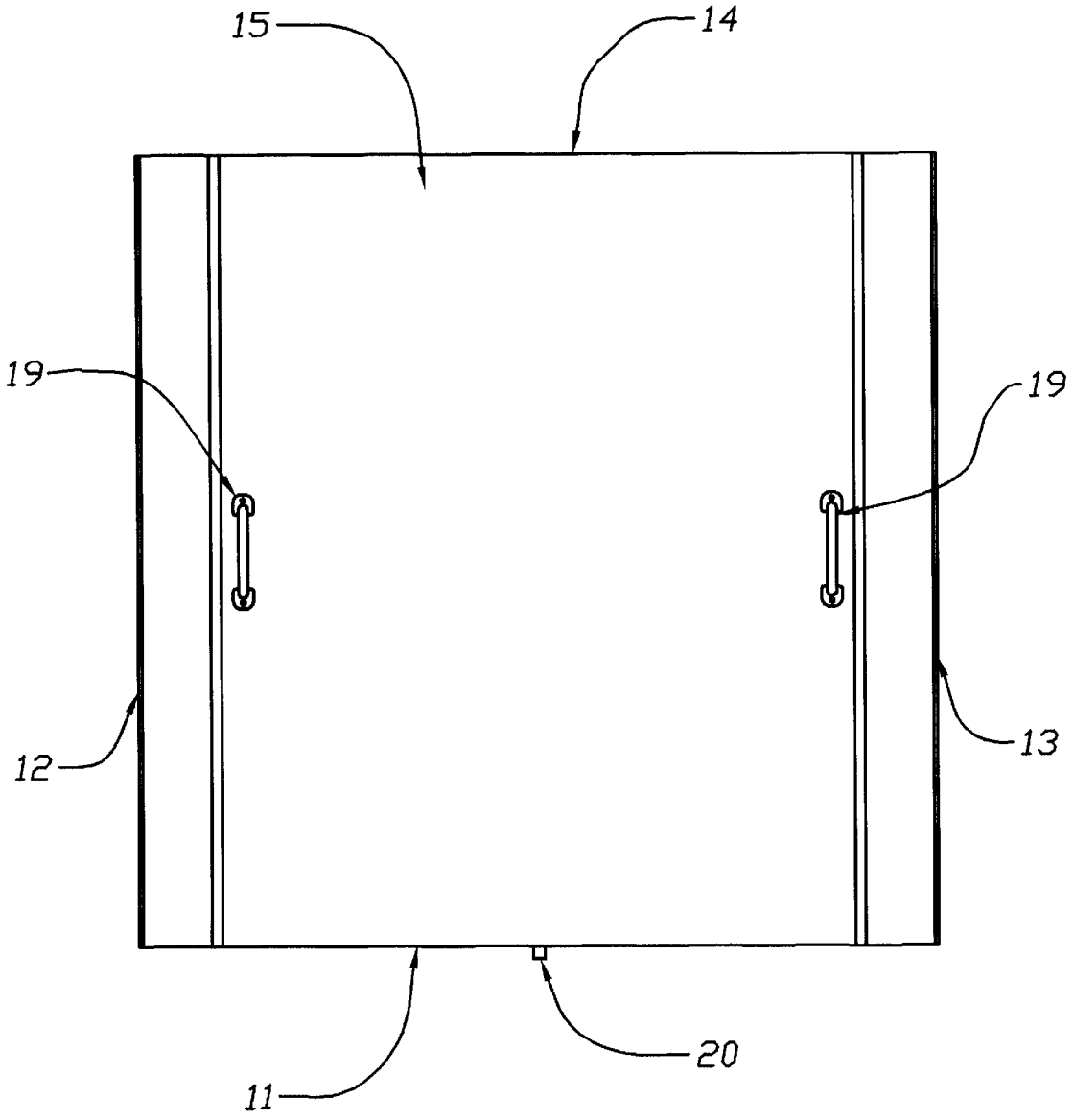
FIG. 3 is a top plan view of the shipping container fully unfolded.

Reference may now be made to the drawings to describe the preferred embodiments. FIGS. 1, 2 and 3 illustrate the exterior appearance of the collapsible shipping container in the fully unfolded configuration. The collapsible shipping container comprises a base portion 10, a front wall 11, a left side wall 12, a right side wall 13, a back wall 14, a top lid 15, and four identical corner posts 16.

The base portion 10 additionally comprises a plurality of skids 17 which allow the collapsible shipping container to be moved by forklift since the spaces under the collapsible shipping container defined by the skids 17 allow access by forklift arms. In an alternative embodiment the collapsible shipping container may be provided with means to accept snap-in casters (not shown) of a type well known in the art so that the collapsible shipping container may be easily moved by rolling.

Assembly of the collapsible shipping container from the fully collapsed configuration into the fully unloaded configuration as shown in FIGS. 1 through 3 will be described more fully hereinafter. However, it may be conveniently noted at this point that the final step of assembly of the collapsible shipping container into the fully unfolded configuration involves placing the top lid 15 into position on top of and surrounding the tops of the fully unfolded and assembled walls 11, 12, 13 and 14. In order to secure the top lid 15 in position, a pair of latches 18 are provided. FIG. 2 shows one of the two latches 18 in relation to the right side wall 13. Not illustrated is the other one of the pair of latches 18 in relation to the top lid 15 and the left side wall 12.

In order to facilitate moving the collapsible shipping container in either the collapsed configuration or the fully unfolded configuration, as well as assisting in the operation of unfolding the collapsible shipping container, the top lid 15 is provided with a pair of handles 19. The handles 19 are sized so as not to interfere with stacking of the collapsible shipping container as will be described more fully hereinafter.

As an additional aid in assembling the collapsible shipping container or moving the fully unfolded collapsible shipping container, the front wall 11 is provided with a collapsible handle 20. The collapsible handle 20 provides a convenient means for grasping and maneuvering the collapsible shipping container in the fully unfolded configuration. The collapsible handle 20 also assists in the assembly of the front wall 11 into the fully unfolded configuration as described more fully hereinafter. The collapsible handle 20 assumes a flattened shape so as not to interfere with the folding of the right side wall 13 onto the front wall 11 when the collapsible shipping container is folded.

In addition to the features described above, the top lid 15 includes a pair of skid channels 21 which act as receptacles to receive the skids 17 so as to ensure the secure stacking of either the collapsed configuration of the collapsible shipping container or the fully unfolded configuration.

Further, the base portion 10 also includes a floor 23 and a front wall channel 22 disposed on the upper front edge of the floor 23 to receive the bottom edge of the front wall 11. The preferred construction of the floor 23 as well as the functioning of the front wall channel 22 will be described more fully below.

Figure 12:
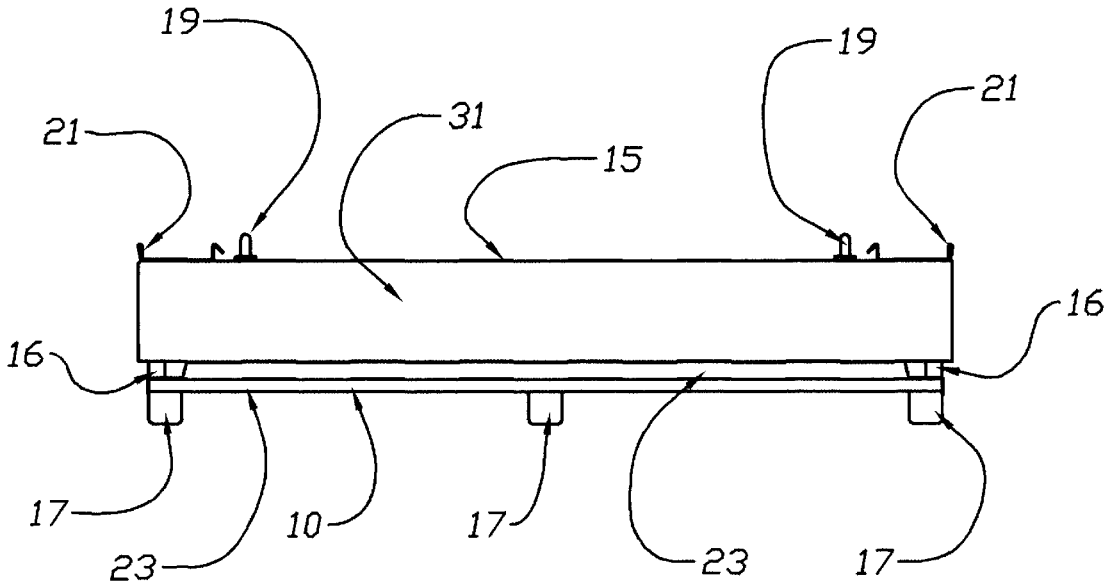
FIG. 12 is a front elevational view of the shipping container in the collapsed configuration.

The fully collapsed configuration of the collapsible shipping container is shown in FIG. 12. As may be seen from FIG. 6, the top lid 15, in addition to the features already described, is essentially a box with a top 30, four sides 31 depending downward therefrom and an open bottom. To proceed from the fully unfolded configuration shown in FIGS. 1 through 3 to the fully collapsed configuration shown in FIG. 12, the following steps occur.

The latches 18 are disengaged and the top lid 15 is lifted off. The handles 19 may assist in this process. The four corner posts 16 may be removed by sliding the corner posts 16 upward. The front wall 11 is at this point held in position only by its lower edge inserted into the front wall channel 22. The collapsible handle 20 may be used to assist in lifting the front wall 11 from the channel 22. The front wall 11 may then be placed on to the floor 23 of the base portion 10. The front wall 11 is sized to fit within the area bounded by the front wall channel 22, the left wall 12, the right wall 13 and the back wall 14. This sequence of folding has the advantage of allowing the stowage of the front wall 11 immediately upon its disassembly from the container. Likewise upon unfolding the walls the front wall 11 is available for assembly without the need to remove it and place it to one side while other assembly is completed.

Figure 6:
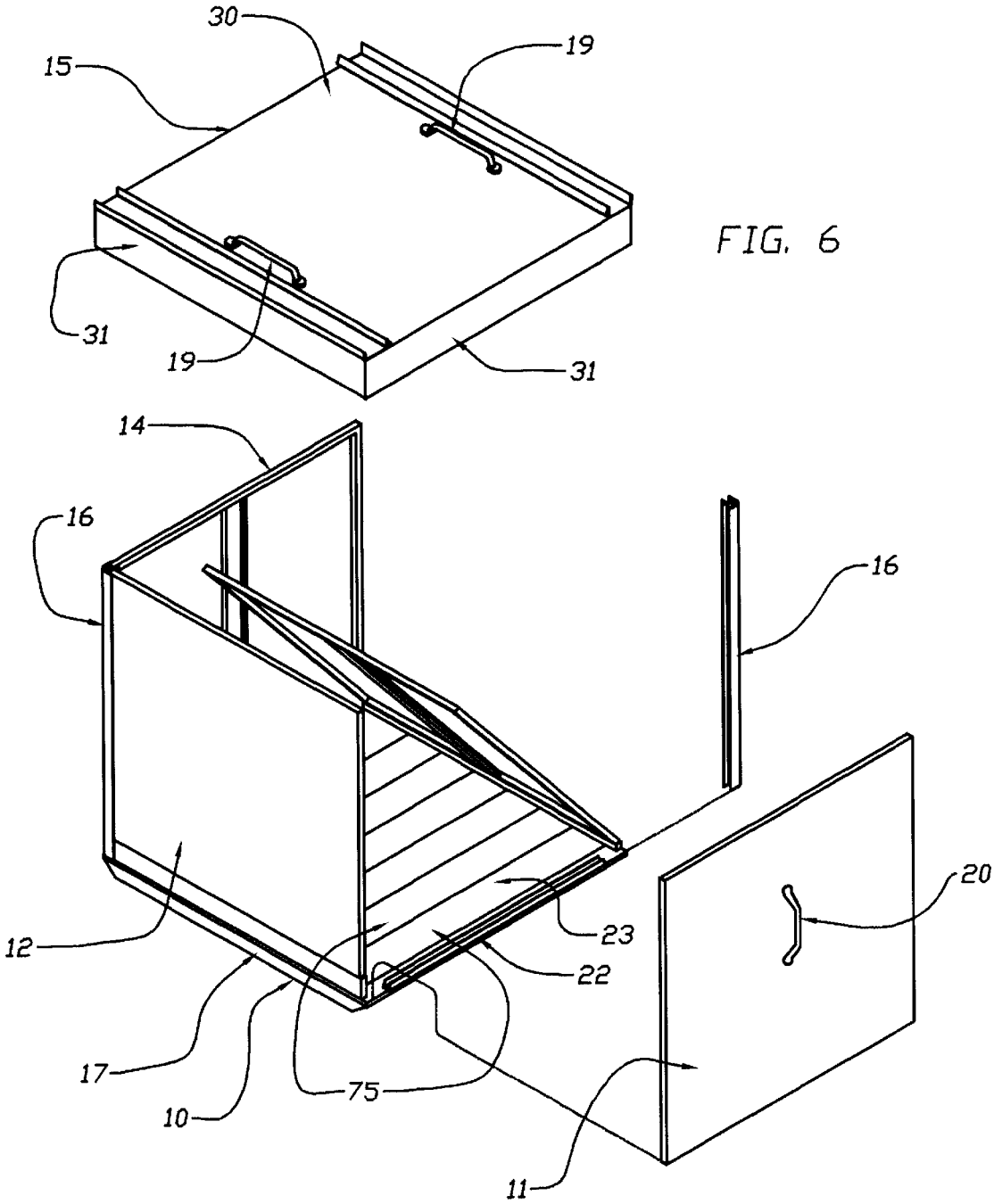
FIG. 6 is an exploded isometric view of the shipping container with the left and rear walls unfolded, the right side wall partially unfolded, and the front wall and top lid ready to be placed in position. Also shown is the left rear corner post assembled and the right front corner post ready to be assembled.

Next, the right wall 13 is folded over onto the front wall 11 as shown in FIG. 6. It should be noted that until either the left wall 12 or the right wall 13 are ready to be folded, the respective corner posts 16 may be left in position between the back wall 14 and the respective left wall 12 or right wall 13 until folding is commenced.

Figure 4:
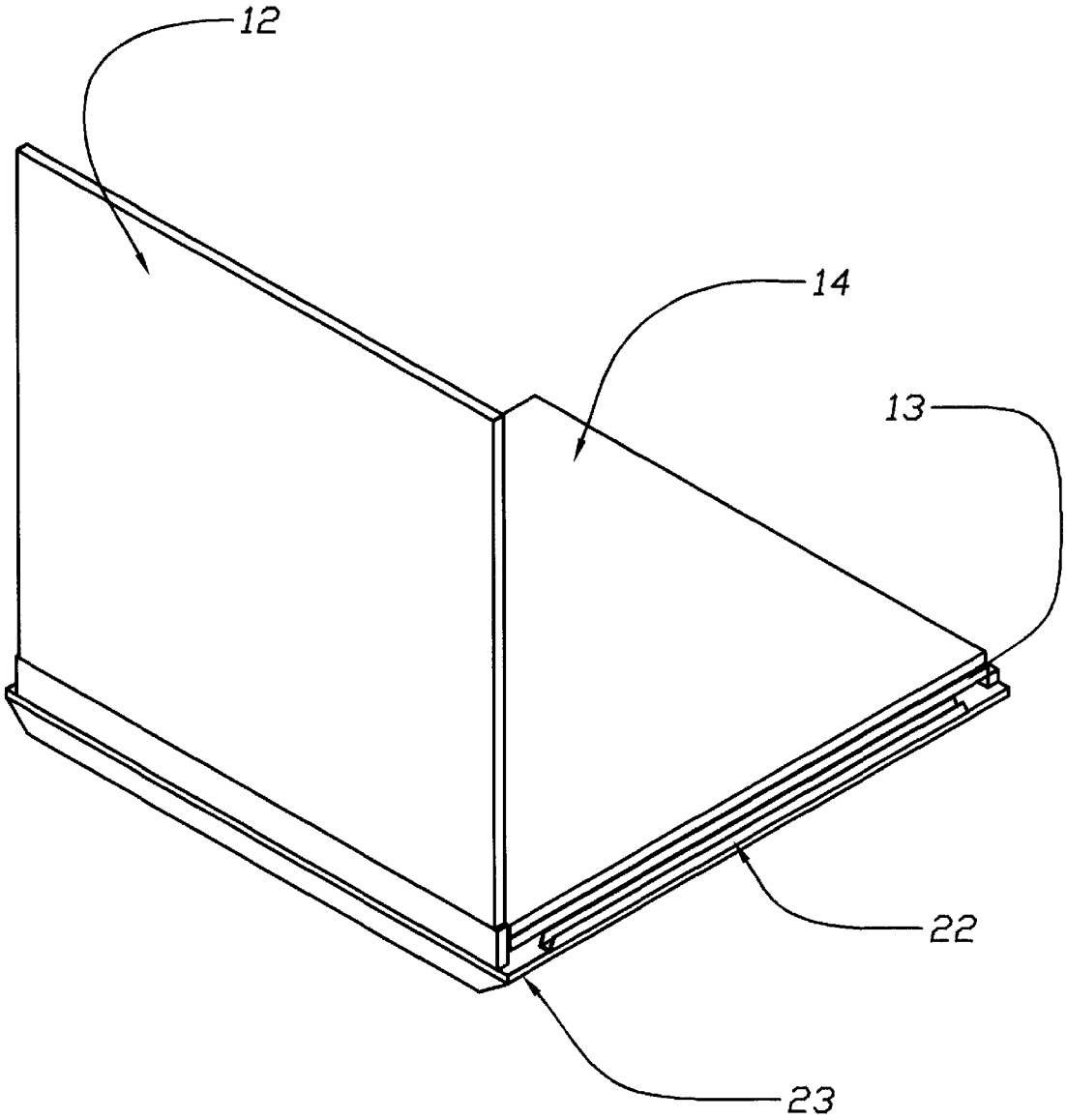
FIG. 4 is an isometric view of the shipping container with the left wall unfolded.
Figure 5:
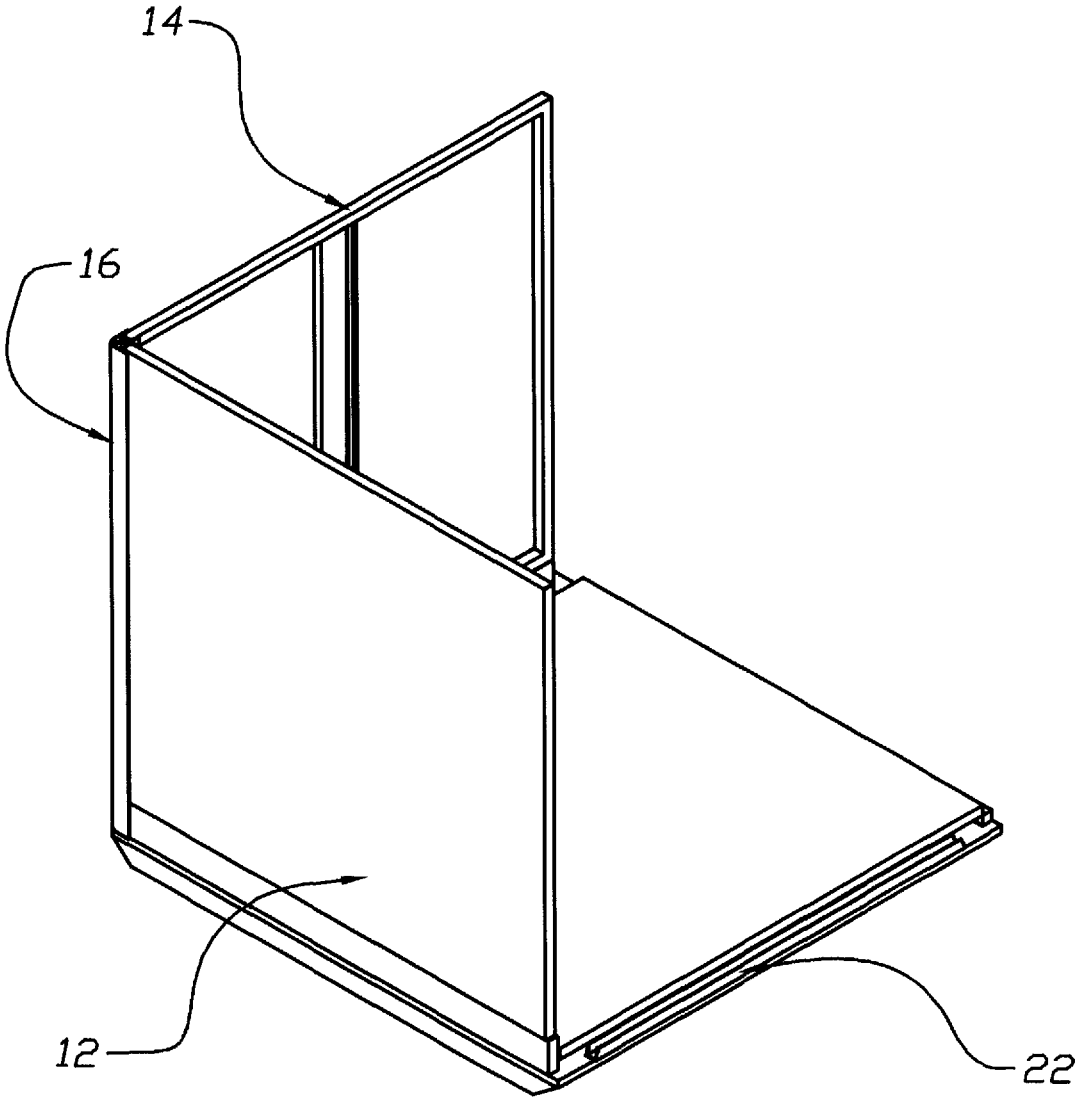
FIG. 5 is an isometric view of the shipping container with the left and rear walls unfolded.

Proceeding with FIGS. 4 and 5, the remainder of the folding may be described. FIG. 5 illustrates the stage in the folding process at which time the front wall 11 and the right wall 13 are fully collapsed. From this point any remaining corner posts 16 may be removed and the back wall 14 folded onto the right wall 13 as shown in FIG. 4. The left wall 12 may then be folded onto the back wall 14.

Figure 11:
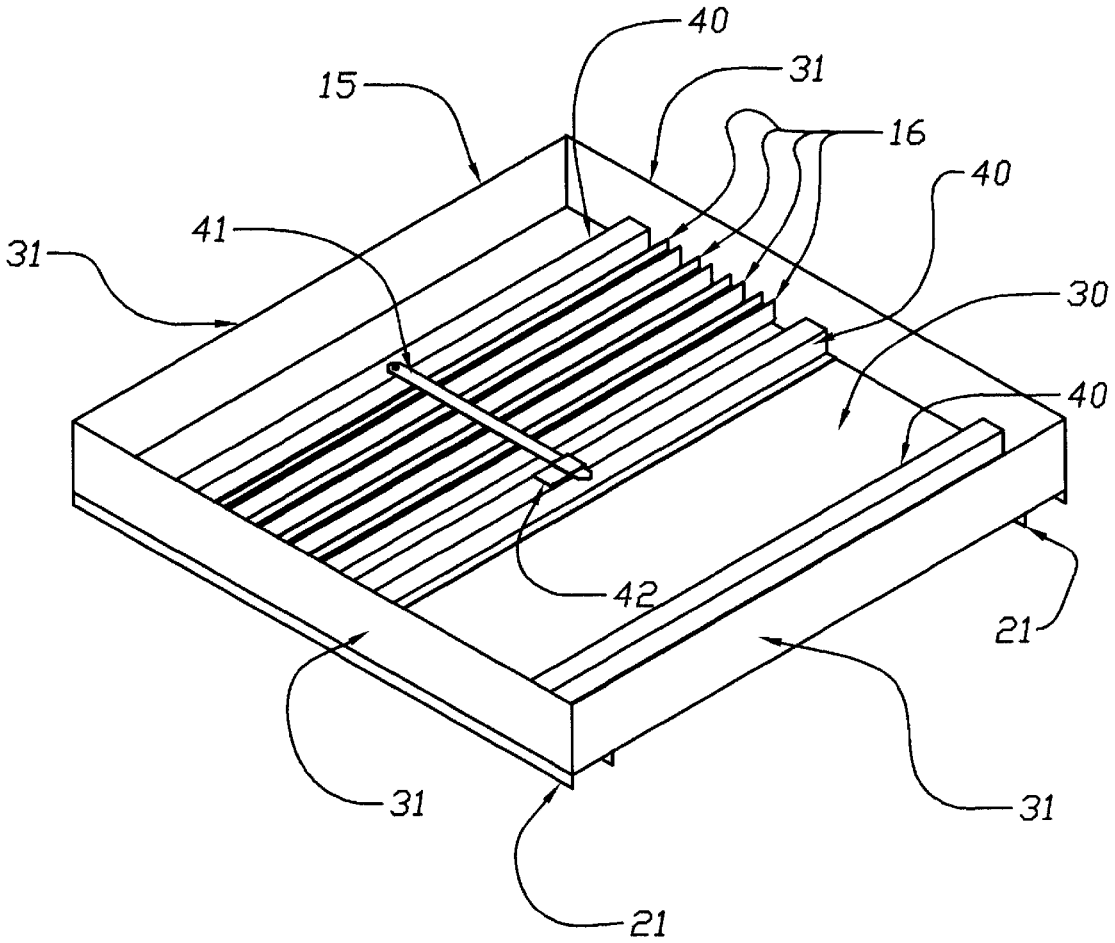
FIG. 11 is an isometric view of the underside of the top lid showing the stowage of the corner posts within the top lid.

The stowing of the corner posts 16 may now be described with reference to FIG. 11. FIG. 11 shows the top lid 15 in a perspective view from the underside. As noted above, the top lid 15 is a box-like structure comprising a top 30 and four sides 31. The strength of the top lid 15 is enhanced by transverse structural members 40. The transverse structural members 40 are disposed on the underside of the top 30 between one pair of opposite sidewalls 31. The transverse structural members 40 are basically box beams, and due to their spacing, define a space between adjacent pairs of the transverse structural members 40, which is employed to receive the disassembled corner posts 16. As shown in FIG. 11, the disassembled corner posts 16 are held in position by a retaining arm 41 which is pivotally mounted to one transverse structural member 40 and received in a retaining bracket 42 located on an adjacent transverse structural member 40.

Figure 13:
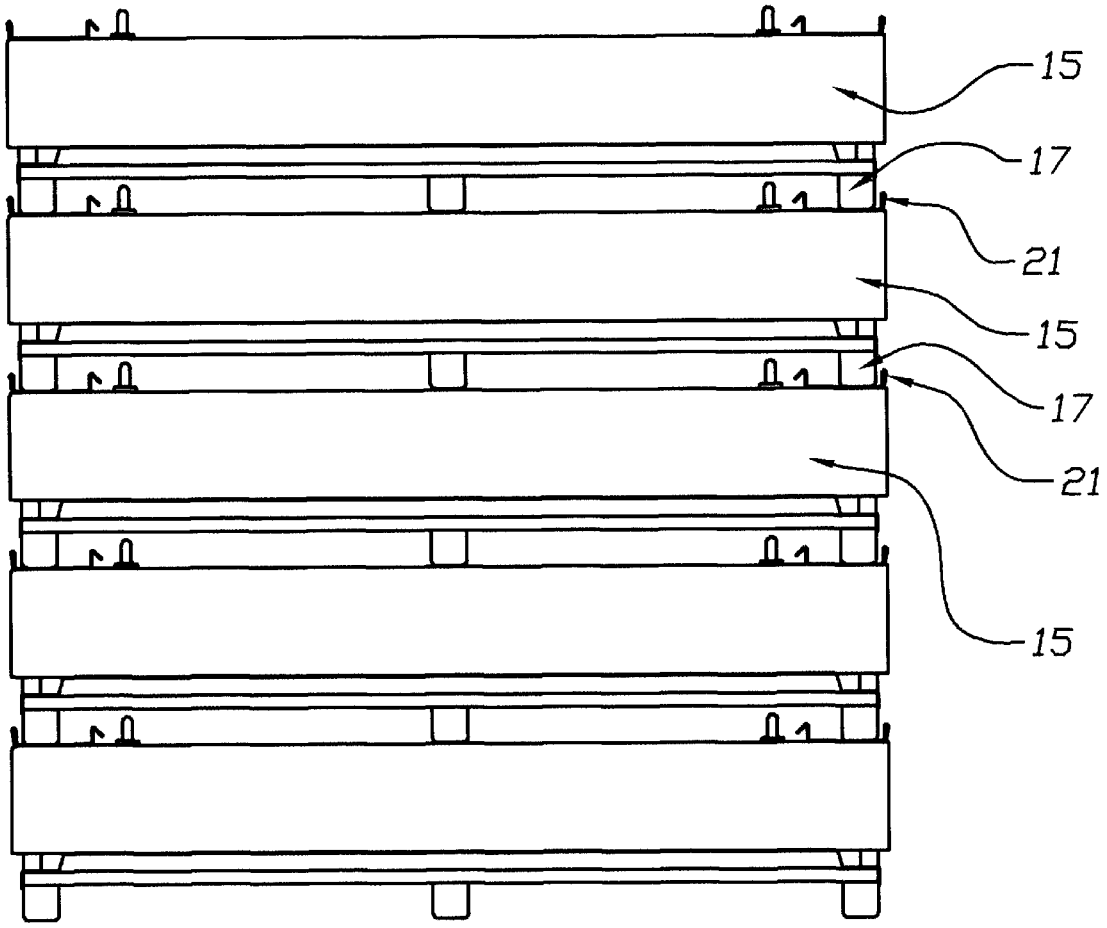
FIG. 13 is a front elevational view of a plurality of collapsed shipping containers stacked for storage or shipment.

After stowing the disassembled corner posts 16 into the top lid 15, the top lid 15 is placed over and on top of the fully collapsed base portion 10 and walls 12, 13 and 14 in a telescopically sliding fashion which substantially surrounds the collapsed walls 11, 12, 13, and 14 with the box-like shape of the top lid 15. The result is the configuration shown in FIG. 12. The collapsible shipping container in the fully collapsed configuration shown in FIG. 12 may be easily stacked for efficient storage or shipment as shown in FIG. 13. FIG. 13 illustrates the manner in which the skids 17 are received in corresponding skid channels 21.

Returning the collapsible shipping container to the fully unfolded configuration involves the reversal of the steps described above. The folding of the walls 12, 13 and 14 have been described generally above. The following describes the manner in which the walls 12, 13 and 14 are hinged to the base portion 10 so as to allow folding of the collapsible shipping container into a minimum configuration. The hinge mechanism of the present invention also assures that when fully unfolded the walls 12, 13 and 14 carry any superimposed loads directly to the base portion 10 without loading the hinges. Furthermore, the hinging mechanism of the present invention assures that when fully folded, any loads superimposed on the walls 12, 13 and 14 are carried directly to the base portion 10 without loading the hinges.

Figure 7A:
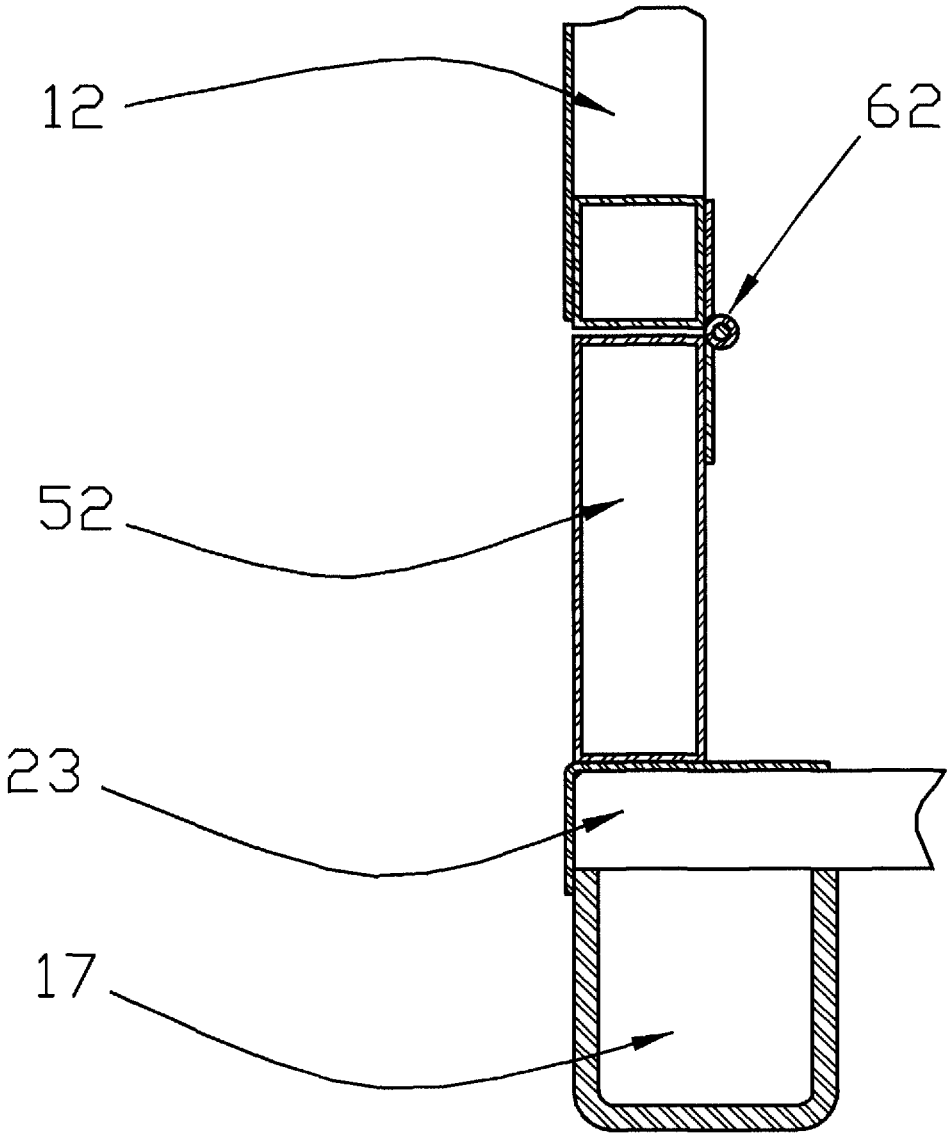
FIG. 7A is a partial sectional elevation view through the left side wall hinge.

The hinge mechanism may be described with reference to FIGS. 7A through 7D. As noted above, the front wall 11 is assembled onto the base portion 10 by placing the lower edge of the front wall 11 into front wall channel 22. This arrangement is shown in a cross-sectional detail in FIG. 7D. It may be seen that any vertical load superimposed on the front wall 11 is passed directly through the front wall channel 22 to the floor 23 and thence to the skid 17. When unfolded, the same relationship holds with the walls 12, 13 and 14 since the hinge is offset and allows the walls 12, 13, and 14 to bear directly on the "stub walls" to be described following. FIG. 7C illustrates the right side wall 13 in a sectional detail. In FIG. 7C the right side wall 13 is unfolded. The right side wall 13 bears directly onto a right side stub wall 50 which is attached to and bears on the floor 23 and thence to the skid 17. The right side stub wall 50 is hingedly attached to the right side wall 13 by a right side hinge 60. The right side stub wall 50 has a height equal to the thickness of the front wall 11. When the disassembled front wall 11 is placed in position on the floor 23, the right side wall 13 may be folded about the right side hinge 60 onto the front wall 11 so that any load superimposed on the right side wall 13 bears uniformly on the front wall 11 without loading the right side hinge 60.

Figure 7B:
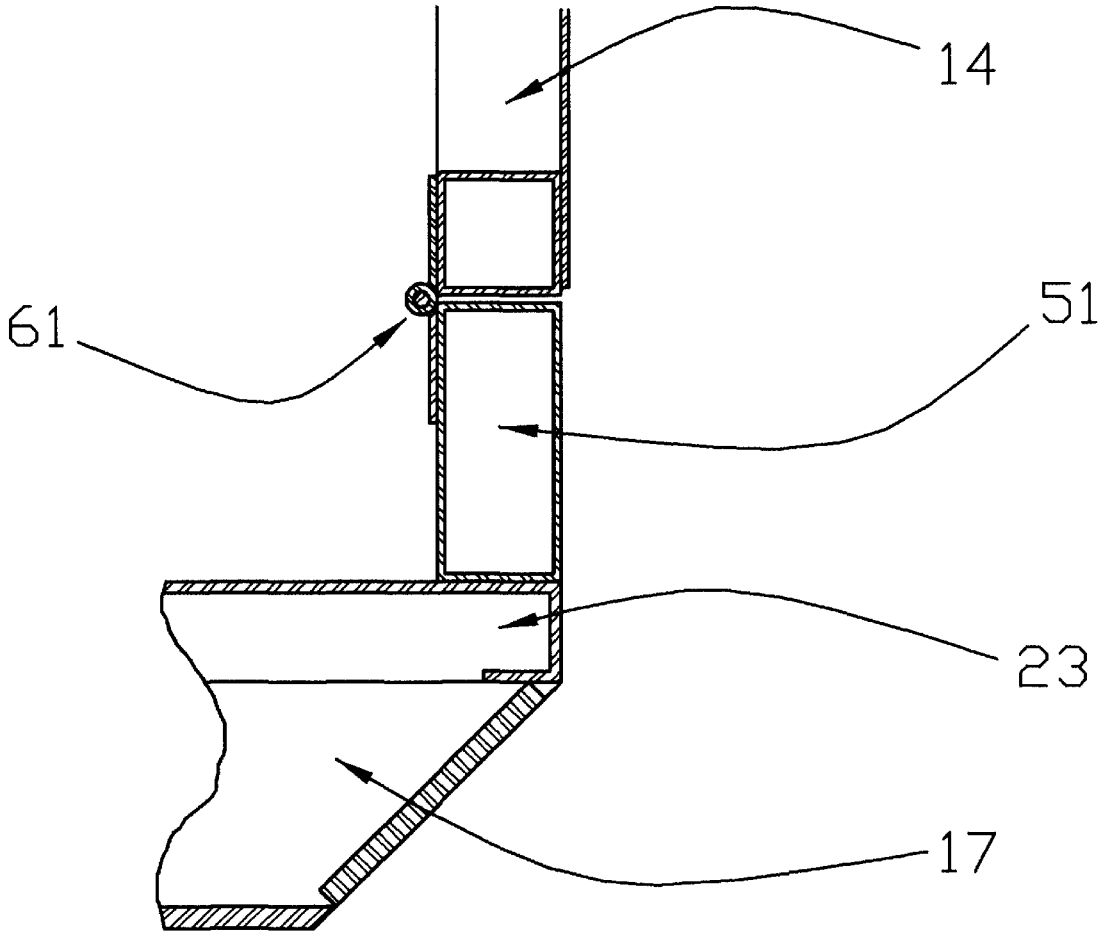
FIG. 7B is a partial sectional elevation view through the back wall hinge.
Figure 7C:
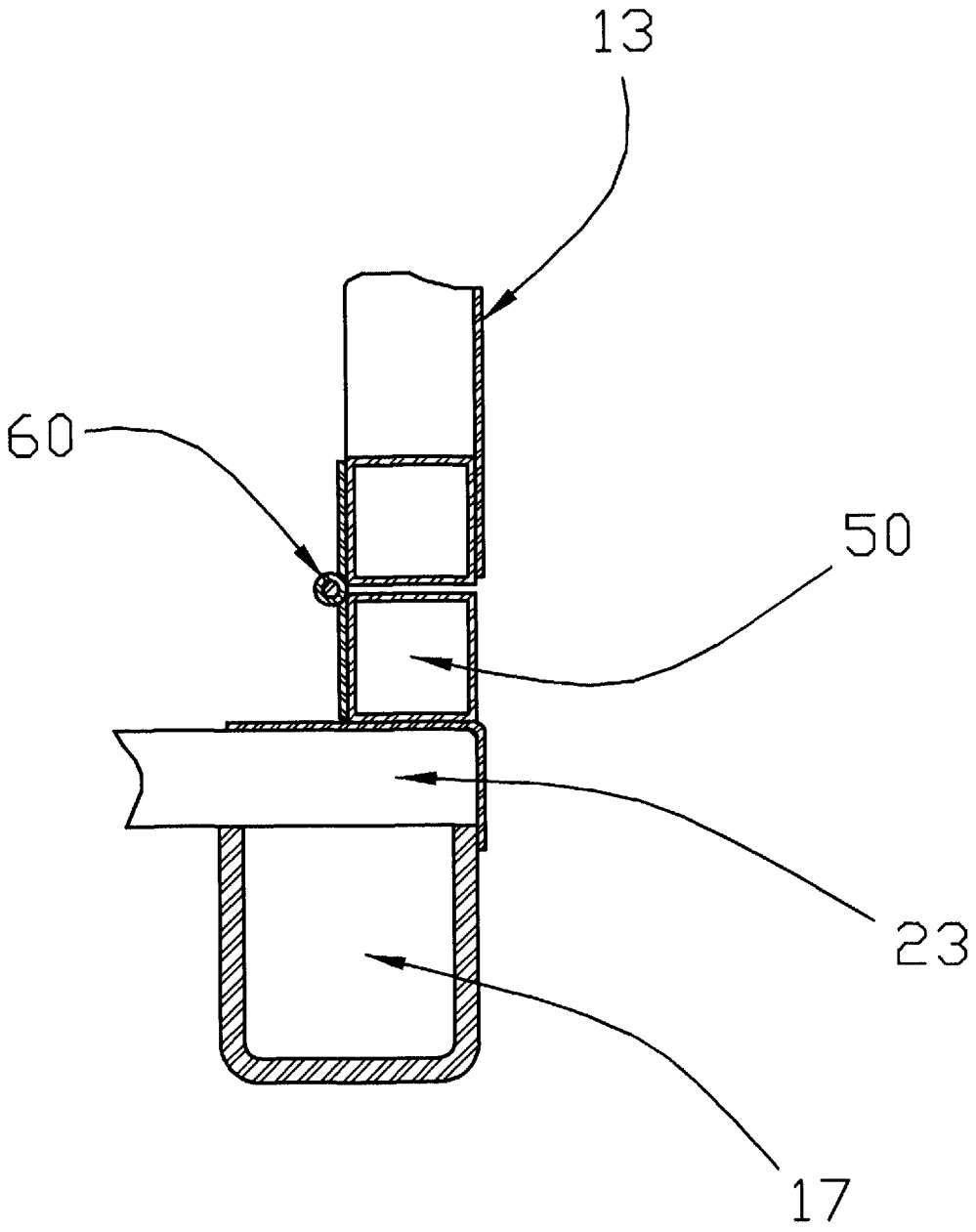
FIG. 7C is a partial sectional elevation view through the right side wall hinge.
Figure 7D:
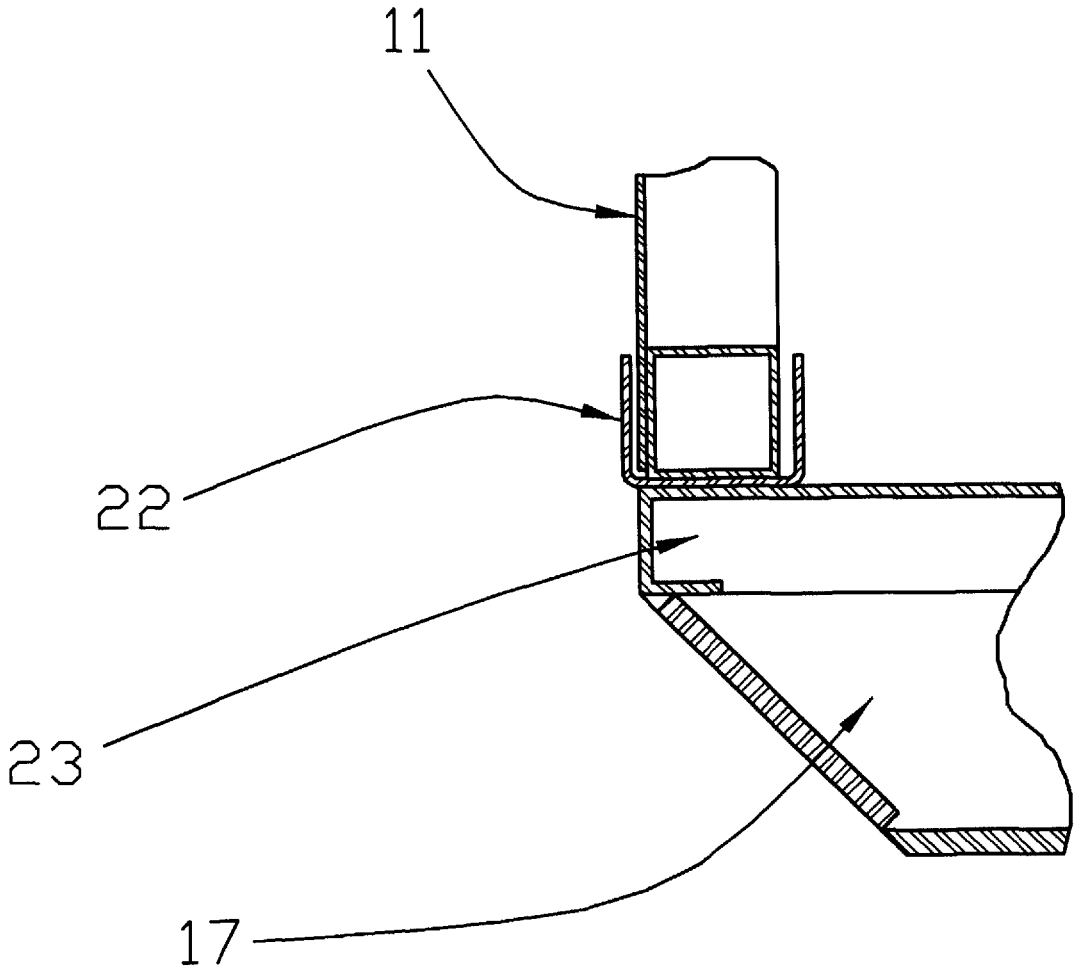
FIG. 7D is a partial sectional elevation view through the front wall channel.

In a precisely analogous fashion as shown in FIG. 7*b*, the back wall 14 is hingedly attached through a back wall hinge 61 to a back stub wall 51 which is affixed to the floor 23. Any load superimposed on the back wall 14 in the unfolded configuration bears directly onto the back stub wall 51 and thence to the floor 23 and the skid 17. The back stub wall 51 has a height equal to the combined thicknesses of the front wall 11 and right side wall 13 so that when folded over onto the right side wall 13, any load superimposed on the back wall 14 in the folded configuration bears uniformly onto the right side wall 13 and thence through the front wall 11 to the floor 23 and the skid 17 without bearing on the back wall hinge 61.

Continuing in analogous fashion to FIG. 7A, the left side wall 12 is hingedly attached to the left side stub wall 52 through the left side wall hinge 62. The left side stub wall 52 has a height equal to the combined thicknesses of the front wall 11, the right side wall 13 and the back wall 14. In the unfolded configuration, any load superimposed on the left side wall 12 bears directly on the left side stub wall 52 and thence through the floor 23 to the skid 17. In the folded configuration, the left side wall 12 is folded about the left side wall hinge 62 onto the back wall 14 and thence through the right side wall 13, front wall 11, floor 23 and skid 17 without loading the left side wall hinge 62. In the preferred embodiment, the thicknesses of the walls 11, 12, 13, and 14 are advantageously uniform and identical. In other embodiments, the thicknesses of the walls 11, 12, 13, and 14 may not be identical, but may be accomodated within the scope of the present invention by adjusting the height of the stub walls accordingly.

While this folding arrangement has been described with the particular sequence of folding the right side wall 13, then the back wall 14, and finally the left side wall 12, the scope of the present invention is not so limited and is intended to encompass other sequences of folding.

Figure 8:
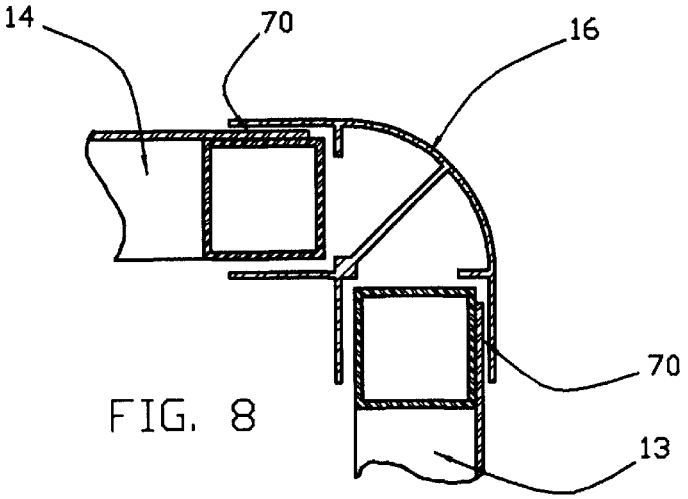
FIG. 8 is a partial sectional top plan view through a corner post and adjacent walls.
Figure 9:
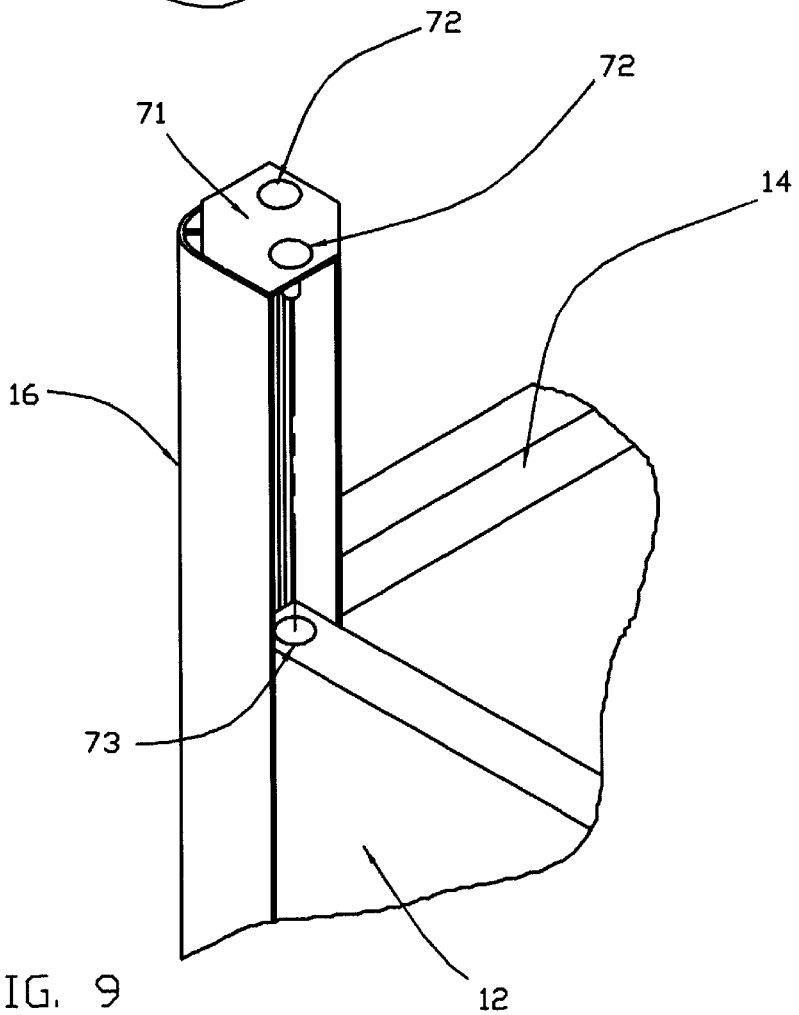
FIG. 9 is a partial isometric view showing the assembly of a corner post to two adjacent walls.

When the collapsible shipping container of the present invention is unfolded into the fully unfolded configuration, a primary consideration becomes the strength of the fully unfolded configuration. The corner post 16 provides the requisite strength in two ways as illustrated in FIGS. 8 and 9. For purposes of illustration, FIG. 8 will be taken to illustrate the manner in which a corner post 16 joins the back wall 14 and right wall 13; however, the same principle applies to the use of the corner post 16 to join any adjacent pair of walls. The corner post 16 comprises a pair of vertical channels 70. The vertical channels 70 are oriented at right angles so as to receive the vertical edges of adjacent walls (in the particular case illustrated in FIG. 8, back wall 14 and right wall 13). The corner post 16 is assembled to a pair of adjacent walls by vertically sliding the channel 70 over the respective edges of the adjacent side walls. This ensures that the adjacent side walls are firmly interlocked along their entire height.

As shown in FIG. 9, however, an additional assurance of a strong and rigid container can be obtained by firmly interlocking adjacent wall panels at their respective top edges. For purposes of illustration, FIG. 9 illustrates the manner in which a corner post 16 interlocks the left wall 12 with the back wall 14. This is merely illustrative, however, and applies to the method of interlocking any adjacent pair of walls. As shown in FIG. 9, the corner post 16 is provided with a gusset 71 horizontally spanning the top of the corner post 16. The gusset 71 is provided with a pair of downward pointing pins 72. Each adjacent wall (12, 14 in this illustration) is provided with an opening 73 along its respective upper edge for receiving the downward pointing pins 72. The corner posts 16 are therefore employed to lock a pair of adjacent walls into position both by the sliding engagement of the channel 70 and by locking the pins 72 into the respective openings 73. By these two means, a thoroughly rigid and fully interlocked structure is achieved.

Additional structural integrity is achieved by placing the top lid 15 onto the assembled structure so that the side walls 31 completely encompass the tops of the assembled walls and corner posts. As noted above, the top lid 15 may then be locked into position by engagement of the latches 18.

Figure 10:
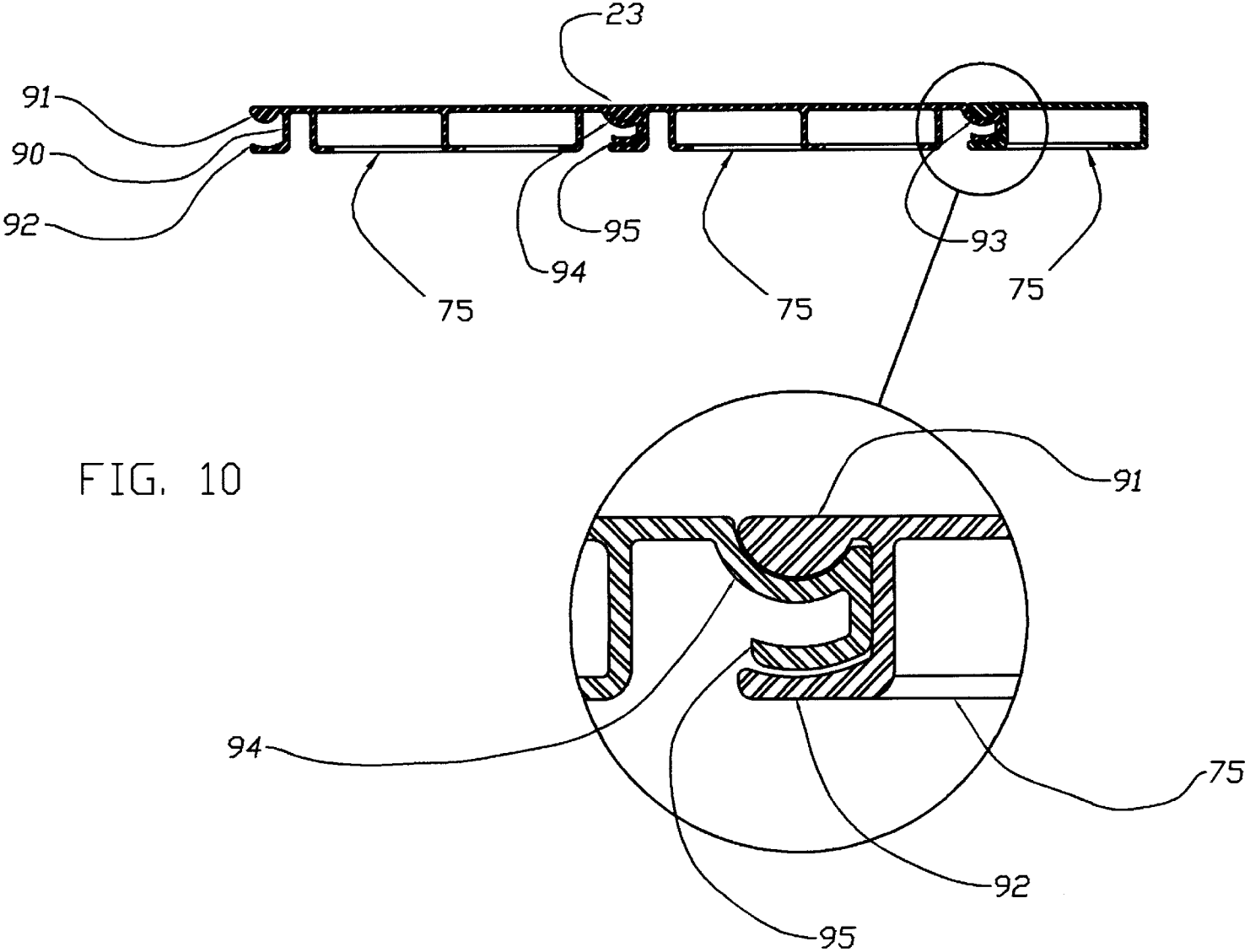
FIG. 10 is a sectional elevation view through the floor showing the construction of the floor from a plurality of interlocking extrusions.

Additional structural integrity is achieved by the method of constructing the floor 23. As illustrated in FIG. 10, the floor 23 is assembled from a plurality of interlocking extrusions 75. This technique allows for ease in manufacture as well as providing great structural strength in an area of the collapsible shipping container which is likely to carry the heaviest load.

As shown in elevation cross section in FIG. 10, each extrusion 75 is provided with a recess 90 along one edge of the extrusion 75. The recess 90 has a convexly radiused upper rim 91 and a concavely radiused lower rim 92. Further each extrusion 75 is provided with a tongue 93 along the opposite edge of the extrusion 75. The tongue 93 has a concavely radiused upper surface 94 and a convexly radiused lower surface 95. The elevation cross section of the recess 90 as shown in FIG. 10 is therefor complementary to the elevation cross section of the tongue 93. Assembly of a first extrusion 75 to a second extrusion 75 is accomplished by placing the second extrusion at angle to the first extrusion and fitting the tongue 93 of the second extrusion 75 into the recess 90 of the first extrusion. Tilting the second extrusion downward slides the tongue 93 into the recess 90 until the tongue 93 is fully seated in the recess 90 and the two extrusions 75 are firmly locked together as shown in FIG. 10.

In order to use the collapsible shipping container for shipping merchandise, the container in the fully collapsed configuration as shown in FIG. 12 is assembled following the steps outlined above. The top lid 15 is removed and the corner posts 16 are removed from the top lid 15. The left side wall 12 is unfolded as shown in FIG. 4 and the back wall 14 is unfolded as shown in FIG. 5. A corner post 16 is then placed in position engaging the left side wall 12 and the back wall 14. Next, the right side wall 13 is unfolded as shown in FIG. 6. An additional corner post 16 is used to assemble the right side wall 13 to the back wall 14. The front wall 11 is then removed and assembled into position in the channel 22. Alternatively, the front wall 11 may be removed and placed to one side so that the collapsible shipping container may be easily loaded through the gap left by the front wall 11. Once the collapsible shipping container is fully loaded, the container assembly may be completed by placing the front wall 11 in position in the front wall channel 22. The front wall 11 is then fixed into position by the assembly of a corner post between the front wall 11 and the left side wall 12 and between the front wall 11 and the right side wall 13. The final step to complete assembly of the fully loaded collapsible shipping container is to place the top lid 15 in position as shown in FIGS. 1 through 3.

The fully assembled and loaded collapsible shipping container may be stacked using the skid 17 and skid channels 21 in precisely the same fashion as shown in FIG. 13 for the fully collapsed configuration. The collapsible shipping container may advantageously be sized so as to fit without wasted space in intermodular shipping containers which are of a standard size. A useful modular size would be 4 feet by 4 feet by 4 feet. However, the present invention is not limited to precisely this size and may advantageously be constructed in varying sizes.

An advantage of the present invention is that it may be assembled without the use of bolts or similar fastening devices. All loose parts are minimized and easily stored, thereby minimizing the risk of loss. Furthermore, the entire assembly and disassembly process may be undertaken manually and without the need for any type of tools.

The present invention has been described with reference to certain preferred and alternative embodiments which are intended to be exemplary only and not limiting to the full scope of the present invention as set forth in the appended claims.

What is claimed is:

1. A collapsible shipping container interchangeable between a collapsed configuration and an unfolded configuration for shipping cargo, comprising:

a rectangular base portion having a flat supporting surface and a plurality of walls, each of said walls comprising a stub wall and a folding wall, said stub walls being affixed to the periphery of the surface of said base portion, and each of said stub walls having a corresponding one of said folding walls hingedly attached thereto for inward folding;

said folding walls each being characterized by a uniform thickness and each of said stub walls having a height equal to a sequential summation of said uniform thicknesses, whereby said folding walls are foldable in superimposed layers;

a removable wall and a wall channel affixed to said periphery of said surface of said base portion for receiving a bottom edge of said removable wall whereby said removable wall forms together with said folding walls said unfolded configuration of the shipping container; and further whereby said stub walls and said wall channel define a space for receiving said removable wall for stowage in said collapsed configuration;

corner posts for connecting adjacent vertical edges of said walls, each of said corner posts comprising a pair of vertical channels, one of said vertical channels being oriented to receive the vertical edge of a wall and the other of said vertical channels being oriented to receive the corresponding edge of an adjacent wall;

a vertically oriented hole at each upper, outer edge of each of said walls, and each of said corner posts further having a pair of downward pointing pins oriented to engage respective pairs of adjacent holes whereby adjacent walls are locked together in the unfolded configuration;

a top lid having a top and downward extending side walls for encompassing in telescopic fashion an upper portion of said walls in the unfolded configuration and substantially all of said walls in the collapsed configuration; wherein said top lid comprises a plurality of box beams disposed on the underside of said top lid and defining a space for receiving said corner posts in the collapsed configuration, a retaining arm pivotally attached to one of said box beams, and a retaining bracket mounted to an adjacent box beam for retaining said corner posts in said space;

wherein said base portion further comprises a plurality of skids.

2. The collapsible shipping container of claim 1 wherein said base portion further comprises a floor comprising a plurality of interlocking extrusions, wherein each of said extrusions comprises a recess along one edge of each of said extrusions, said recess having a convexly radiused upper rim and a concavely radiused lower rim and a tongue along an opposite edge of each of said extrusions, said tongue having concavely radiused upper surface and a convexely radiused lower surface such that a cross section of said recess is complementary to a cross section of said tongue whereby a first extrusion may be assembled to an adjacent extrusion by placing said first extrusion at a angle to said adjacent extrusion, inserting a tongue of said first extrusion into a recess of said adjacent extrusion, and tilting said first extrusion to slide said tongue into said recess.

3. The collapsible shipping container of claim 2 further comprising latching means for securing said top lid to said walls.

4. The collapsible shipping container of claim 3 wherein said top lid further comprises a plurality of skid channels for receiving the skids of a second collapsible shipping container in stacked relationship.

* * * * *